US006186132B1

(12) United States Patent
Ko

(10) Patent No.: US 6,186,132 B1
(45) Date of Patent: Feb. 13, 2001

(54) ON-COURT SERVICE MACHINE FOR TABLE TENNIS

(76) Inventor: Chen-Chun Ko, 13F, No. 77-1, Chang-Yang S Rd., San-Chung City, Taipei Hsien (TW)

( * ) Notice: Under 35 U.S.C. 154(b), the term of this patent shall be extended for 0 days.

(21) Appl. No.: 09/294,326

(22) Filed: Apr. 20, 1999

(51) Int. Cl.[7] ..... F41B 4/00; A63B 67/04
(52) U.S. Cl. ..... 124/6; 473/460
(58) Field of Search ..... 124/6, 78; 473/459, 473/460, 475, 496

(56) References Cited

U.S. PATENT DOCUMENTS 3,306,613 * 2/1967 Mainers ..... 124/6 X
4,203,413 * 5/1980 Hodges ..... 124/78
4,883,272 * 11/1989 Lay ..... 124/6 X
5,383,658 * 1/1995 Newgarden ..... 473/475
5,417,196 * 5/1995 Morrison et al. ..... 124/6
5,533,722 * 7/1996 Lu ..... 473/460
5,938,204 * 8/1999 Tzeng et al. ..... 473/460 X

* cited by examiner

*Primary Examiner*—John A. Ricci
(74) *Attorney, Agent, or Firm*—Bacon & Thomas

(57) ABSTRACT

A service machine mountable on a court for table tennis comprises a service machine body, wherein a micro-controller is used to control a ball-positioning mechanism built in the service machine body and a ball-projecting mechanism coupled with the ball-positioning mechanism. The ball-positioning mechanism further comprises an elevation control motor and a sway control motor, while the ball-projecting mechanism comprises a ball-conveying device and a ball-projecting device. A ball-collecting tray is arranged to collect plural balls, which will be delivered via a conveyer from the service machine body to the ball-projecting device sequentially through the ball-positioning mechanism and a spin. control motor for projection. The micro-controller can be set by a user or provided with a preset program to enable the service machine to shoot spun balls one after another at various angles or directions in continuous or intermittent mode automatically or manually.

6 Claims, 10 Drawing Sheets

ON-COURT SERVICE MACHINE FOR TABLE TENNIS

BACKGROUND OF THE INVENTION

The invention relates to a service machine for table tennis, and particularly to a service machine that is mountable on a court for table tennis.

The table tennis game is widely considered as one of the popular sports all over the world, partly because it doesn't require a large indoor space or expensive facilities, since a table with a net is essentially all that is required to play the game. It permits people of different age, stature, or sex to play and enjoy together, and basically a player needs nothing more than a personal bat. One can hardly find another sport item as convenient and inexpensive as the table tennis game.

However, one cannot make progress in playing skill alone, and will need a decent partner to practice constantly in order to raise his skill level, and also a training course under a coach's guidance. For this purpose, some service machines have been developed and provided for people to practice receiving skill on their own and without a partner. Unfortunately, when using a conventional service machine, a user has to go across the table from time to time to the service machine for resetting another mode or function if a change in the service style is desired. This procedure tends to reduce a player's interest in the game.

Subsequently, some machines closer to human function have been proposed, such as shown in U.S. Pat. Nos. 5,485,995 and 5,566,936. Other examples are shown in U.S. Pat. Nos. 4,917,380 and 5,009,412.

SUMMARY OF THE INVENTION

This invention relates to an improved structure for a service machine mountable on a court for table tennis, having a service machine body connectable with the court and provided with a micro-controller used to control a ball-positioning mechanism built in the service machine body and a ball-projecting mechanism coupled with the ball-positioning mechanism. The ball-positioning mechanism includes an elevation control motor for adjusting the elevation angle, and a sway control motor for adjusting the deflection angle of the ball-projecting mechanism. The ball-projecting mechanism further comprises a ball-conveying device and a ball-projecting device. The ball-conveying device includes a ball-collecting tray that collects plural balls and sends them, via a conveyer, from the service machine body to the ball-projecting device of the ball-projecting mechanism sequentially through the ball-positioning mechanism. The ball-projecting device is provided with a propelling wheel that controls the ball speed, and snap shots can be made sequentially due to engagement friction between the balls and the propelling wheel. After a ball is shot, the micro-controller will instruct the conveyer to replenish a new ball. The propelling wheel will also cooperate with a spin control motor to change the positional angle of the frictional snap shot for further control of the spin direction of a shot ball. The micro-controller can be set by a user or preset with a program to enable the service machine to project spun balls continuously or intermittently at various angles and directions automatically or manually.

BRIEF DESCRIPTION OF THE DRAWINGS

For a better understanding of the present invention, together with further advantages and features thereof, at least one preferred embodiment will be described below with reference to the annexed drawings in which.

DETAILED DESCRIPTION OF THE PREFERRED EMBODIMENT

Figure 1:
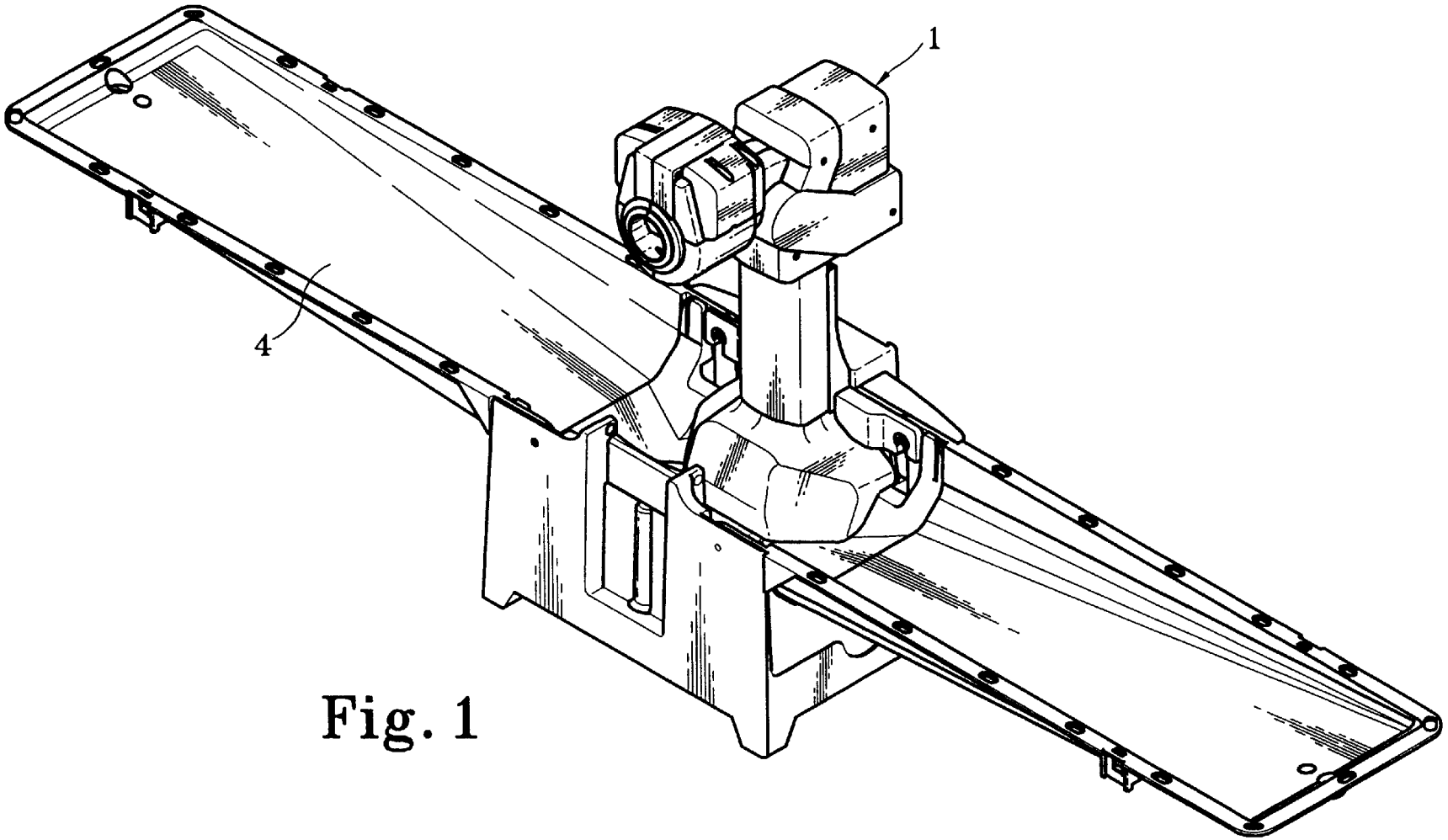
FIG. 1 is a perspective view of the invention.
Figure 5:
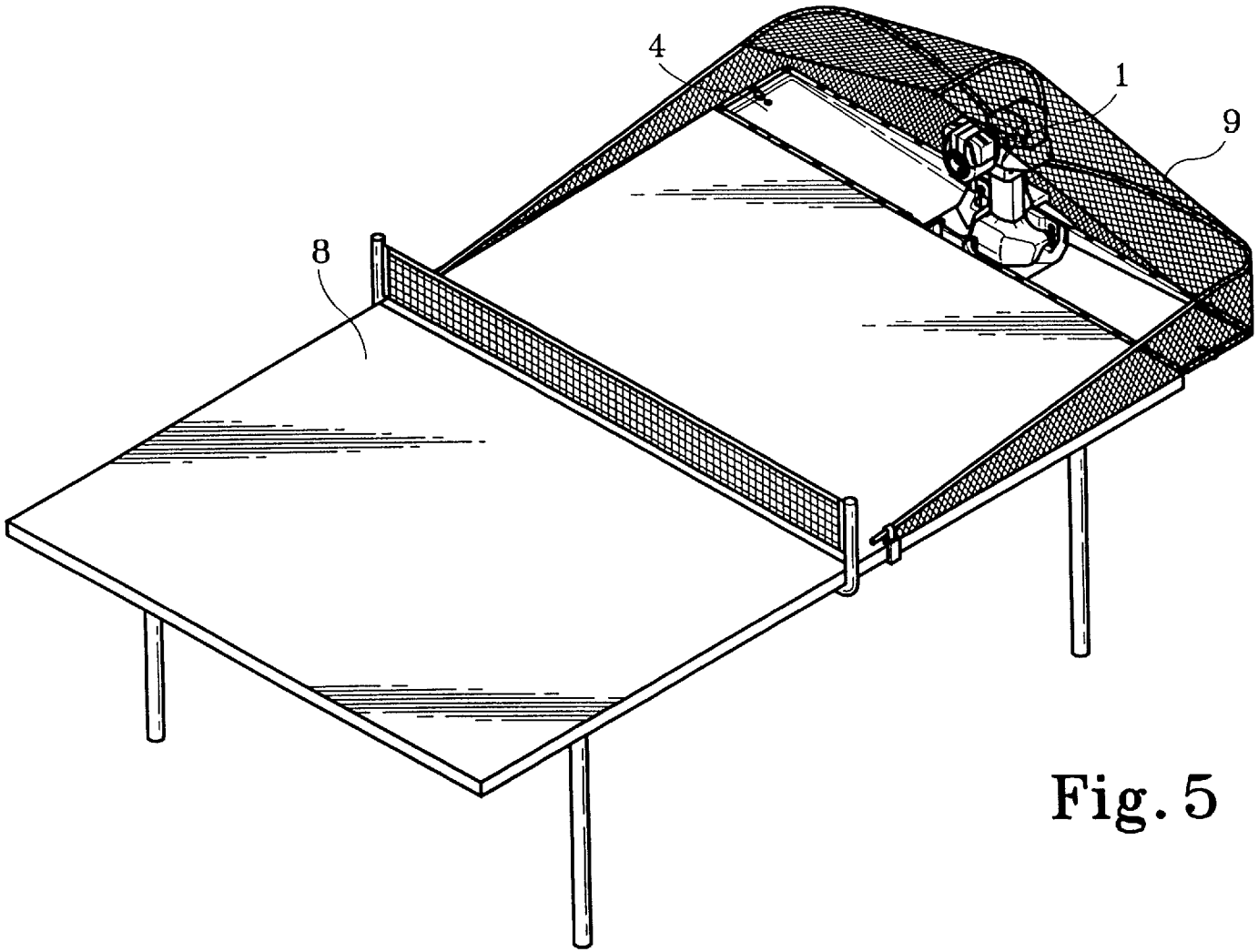
FIG. 5 is a perspective view of a common court and net frame with the invention installed therewith.
Figure 6:
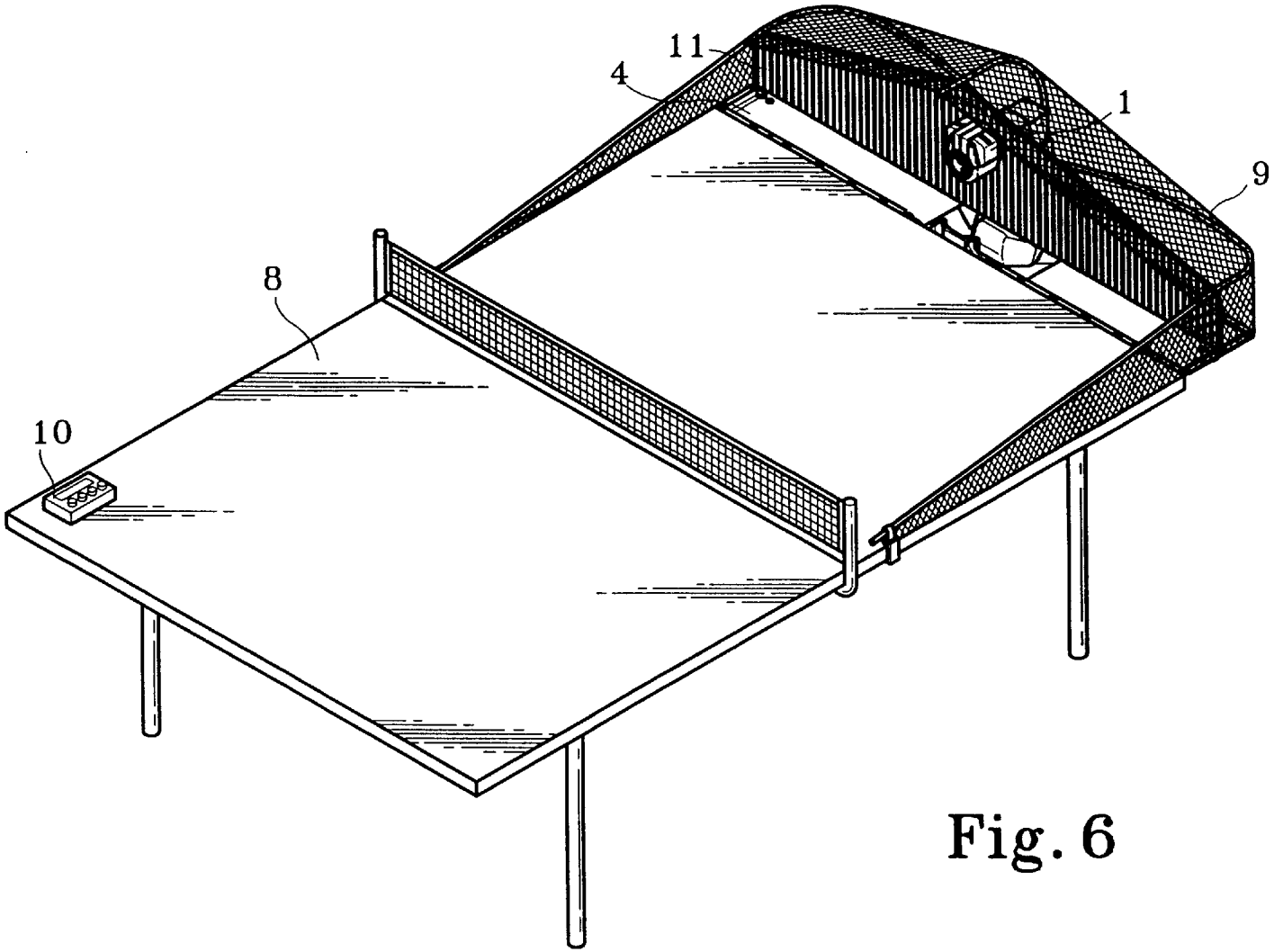
FIG. 6 is a perspective view of a preferred embodiment of a net frame.

As shown in FIG. 1, this invention relates to an improved structure of an on-court service machine for a table tennis game and including a service machine body 1 mountable on a court 8, as shown in FIG. 5 or FIG. 6, wherein a micro-controller (not shown) is provided with the service machine body 1 for automatic or manual control of a ball-positioning mechanism built in the service machine body 1 and a ball-projecting mechanism coupled with the ball-positioning mechanism.

Figure 2:
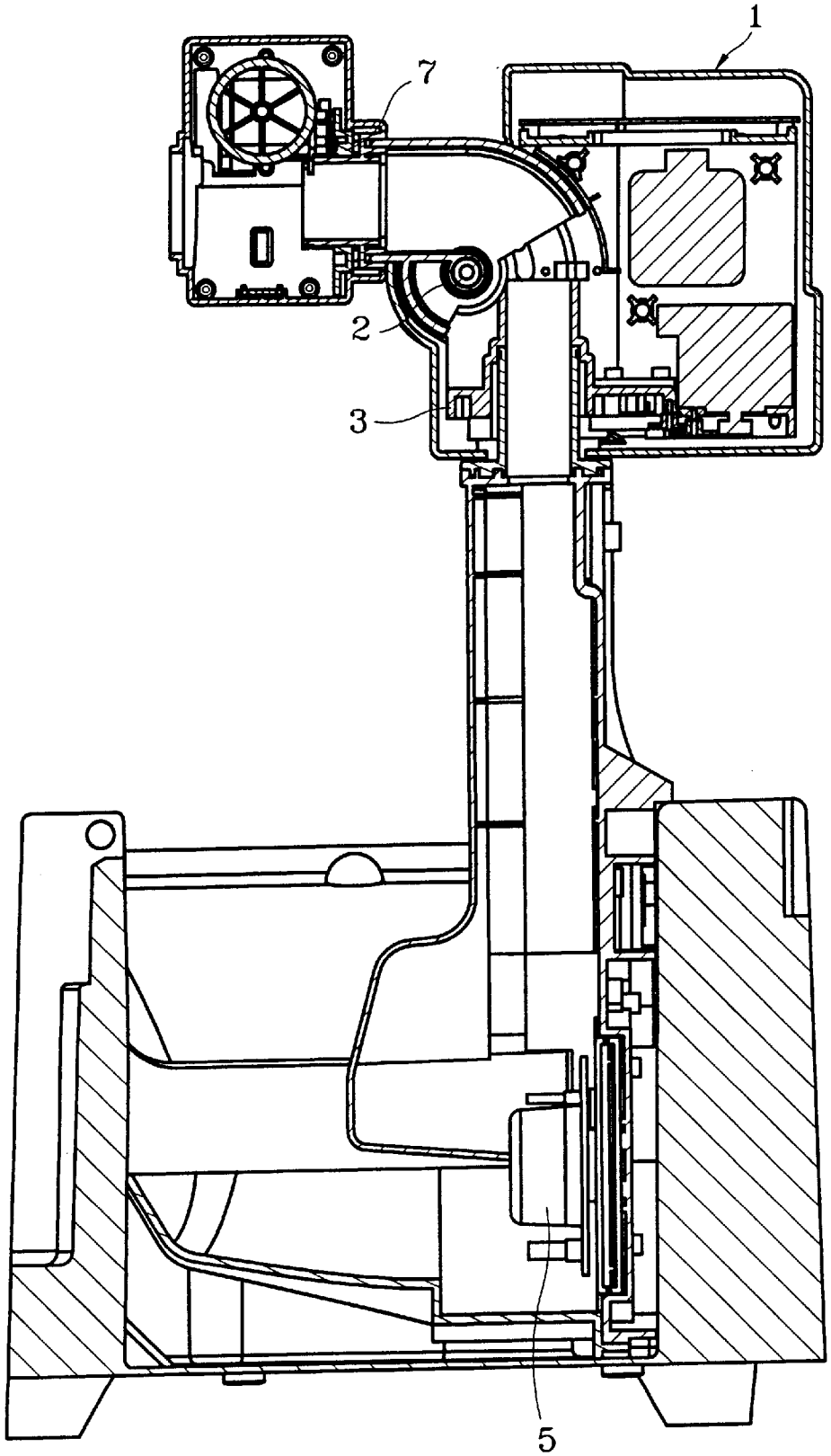
FIG. 2 is a cutaway sectional view of the invention.
Figure 3:
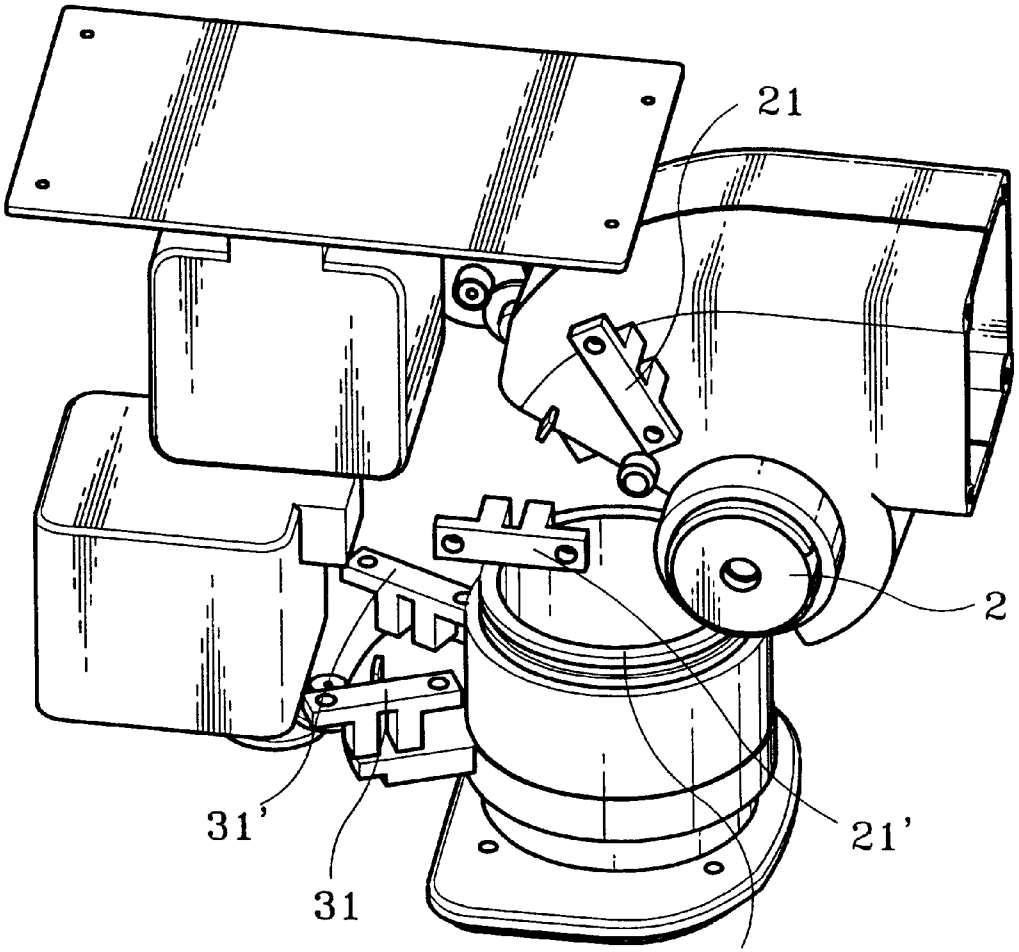
FIG. 3 is a perspective view of a ball-positioning mechanism of the invention.

Referring to FIG. 2 and FIG. 3, the ball-positioning mechanism includes an elevation control motor 2 for adjusting the angle of elevation and a sway control motor 3 for adjusting the angle of deflection. Both the control motors 2, 3 may be further provided with one set of angle sensors 21, 21' and 31, 31', respectively, to enable the micro-controller to control the elevation and deflection of a projected ball more accurately.

The ball-projecting mechanism further comprises a ball-conveying device and a ball-projecting device, wherein the ball-conveying device has a ball-collecting tray 4 that can hold a few balls. The ball-collecting tray 4 is sloped for easy collection and conveyance of the balls to the service machine body 1 via a conveyer 5, and then to a ball-projecting device of the ball-projecting mechanism sequentially via the ball-positioning mechanism.

Figure 4:
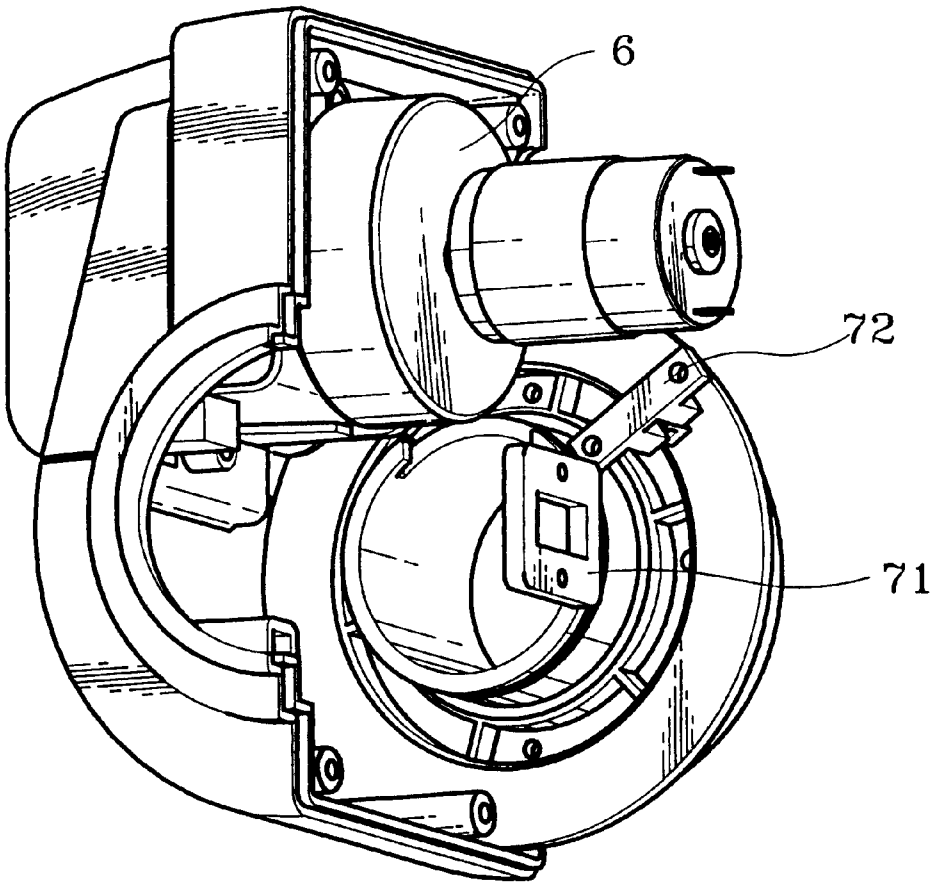
FIG. 4 is a perspective view of a serving device of the invention.

As shown in FIG. 4, a propelling wheel 6 disposed in the ball-projecting device is used to snap shoot the balls delivered from the conveyer 5, one after another, at different speeds by different instantaneous frictional impulsive forces. After a ball is shot, a projecting sensor 71 will transmit a signal to the micro-controller and request the conveyer 5 to replenish the next ball for another shot. Both the elevation control motor 2 and the sway control motor 3 stand ready at their designated positions for the next shot and according to instructions from the micro-controller.

As FIG. 2 and FIG. 4 indicate, the positional angle of the propelling wheel 6 during the instantaneous frictional engagement with a ball can be changed by a spin control motor 7, which can further control the spin direction of a projecting ball, i.e. top spin, back spin, left spin, right spin or lateral spin. An angle sensor 72 may be disposed with the spin control motor 7 for the micro-controller to control the various spins.

By employing the angle sensors 21, 21', 31, 31', 72 and the projecting sensor 71, this invention enables the elevation control motor 2, the sway control motor 3, and the spin control motor 7 to conduct an omnidirectional and natural human control of ball elevation, deflection or spin in continuous or intermittent mode by automatic or manual operation.

FIG. 5. shows an embodiment of a common net frame, wherein a service machine body 1 is installed laterally at one end of a court 8, and a net frame 9 is used to stop the projected balls. However, a sloped ball-collecting tray 4 usually cannot collect most of the projected balls successfully due to the bouncing force of the balls against the net frame 9, thus adversely affecting the operation of the service machine body 1.

FIG. 6 shows a preferred embodiment of a net frame, wherein the service machine body is installed laterally at one end of the court 8, a net frame is used to stop the projected balls, and a curtain 11 is used to buffer the impact force. The projected balls can thus be easily intercepted and entrapped into the ball-collecting tray 4 and used by the service machine body 1 repeatedly and automatically.

As shown in FIG. 6, an infrared controller 10 can be further provided with the micro-controller for remote control of the control program or operation of the micro-controller in order to achieve diversified training programs.

Figure 7:
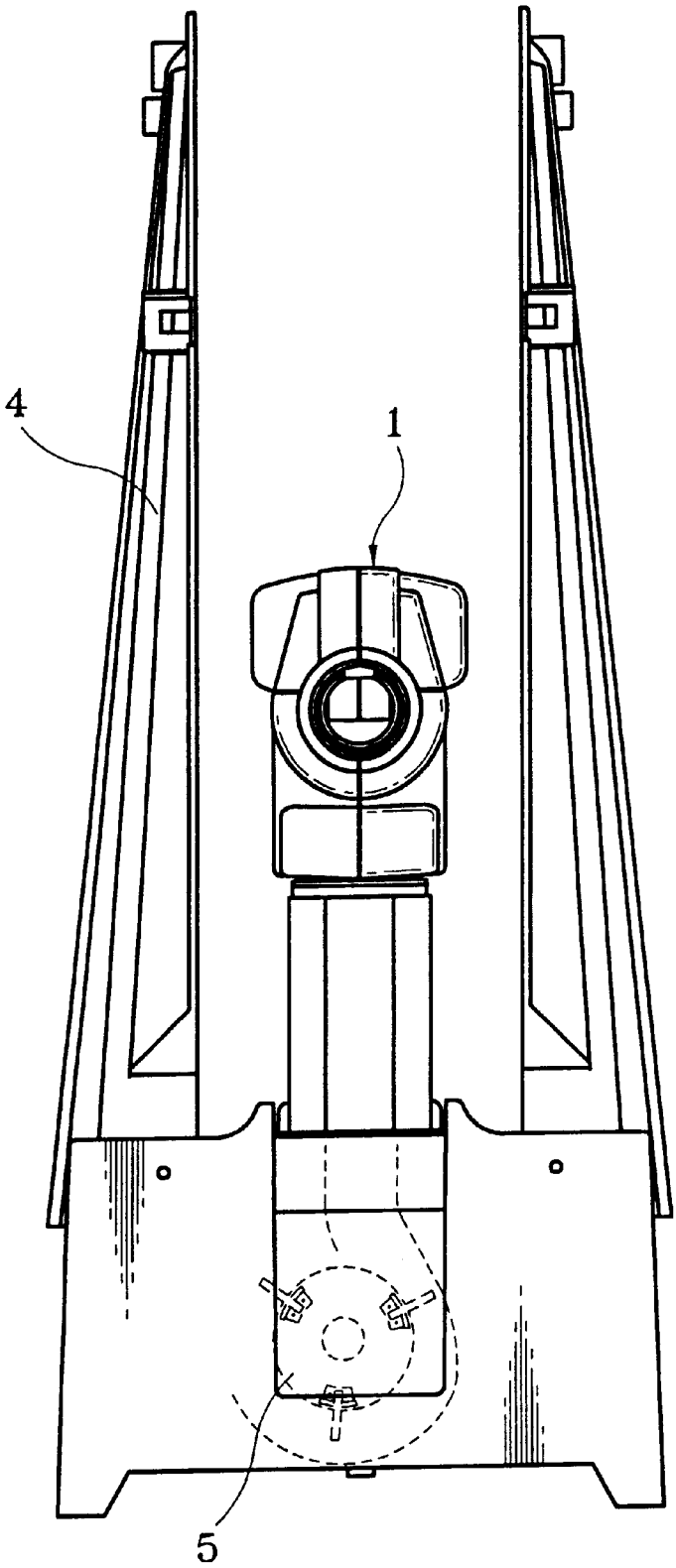
FIG. 7 is an elevational view of a folded ball-collecting tray of the invention.

Another feature of this invention is shown in FIG. 7, wherein the ball-collecting tray 4 may be folded on the service machine body 1 to reduce overall volume for storage or transport.

Figure 8:
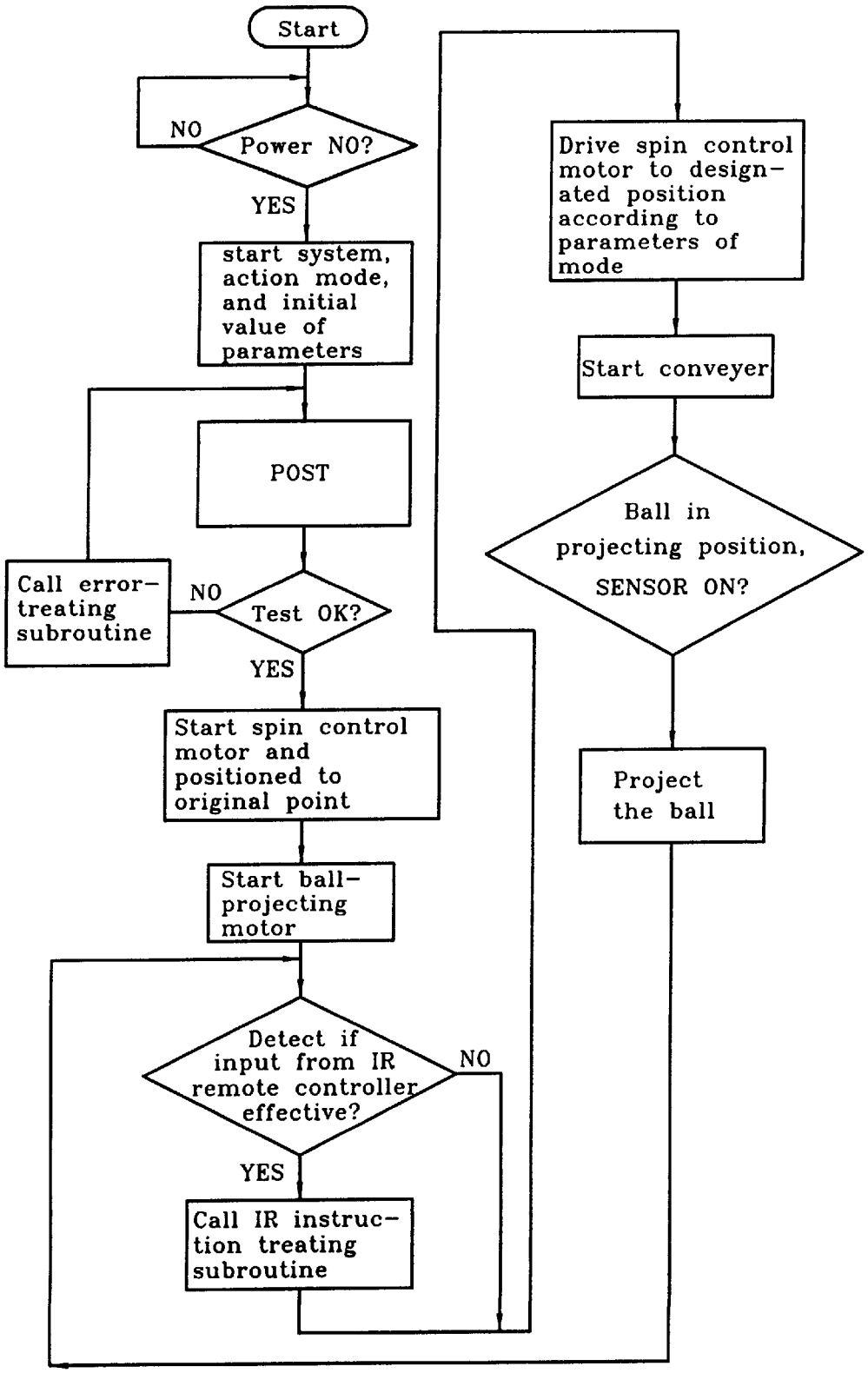
FIG. 8 is a control flow chart of a micro-controller of the invention.
Figure 9:
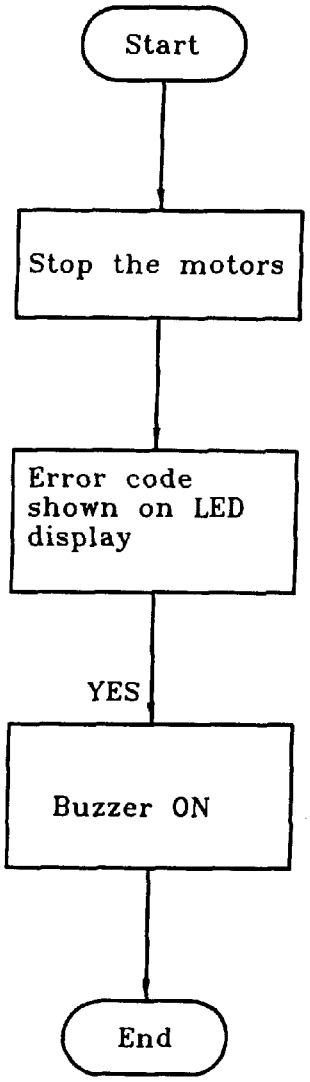
FIG. 9 is a control flow chart of a malfunctioned micro-controller of the invention.
Figure 10:
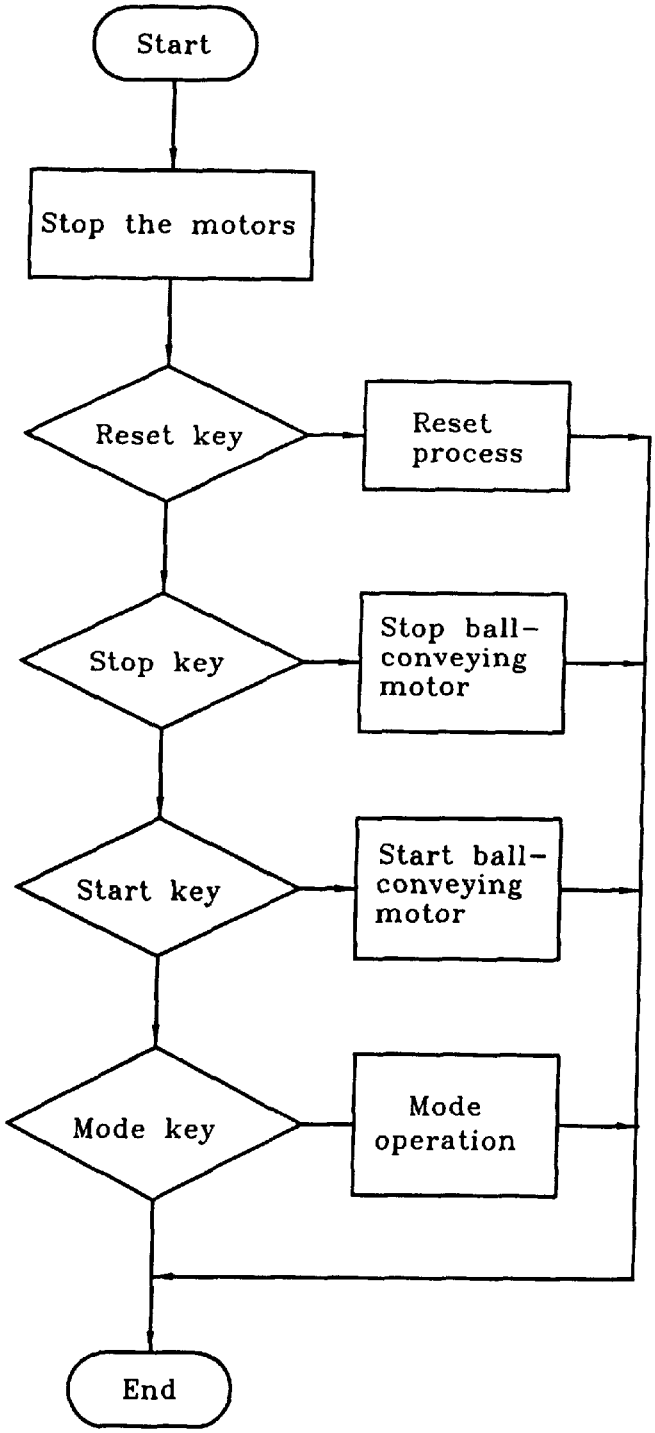
FIG. 10 is a control flow chart showing the micro-controller of the invention under control of an infrared controller.

Referring to FIGS. 6, 8 and 9, when a user begins to use this invention, he must first install the invention and switch the power supply "ON" for the micro-controller to start the system and conduct the system self-test. In the event of a fault, all the motors are stopped and an error message will be shown in an LED display accompanied by a warning alarm from a buzzer.

Figure 11:
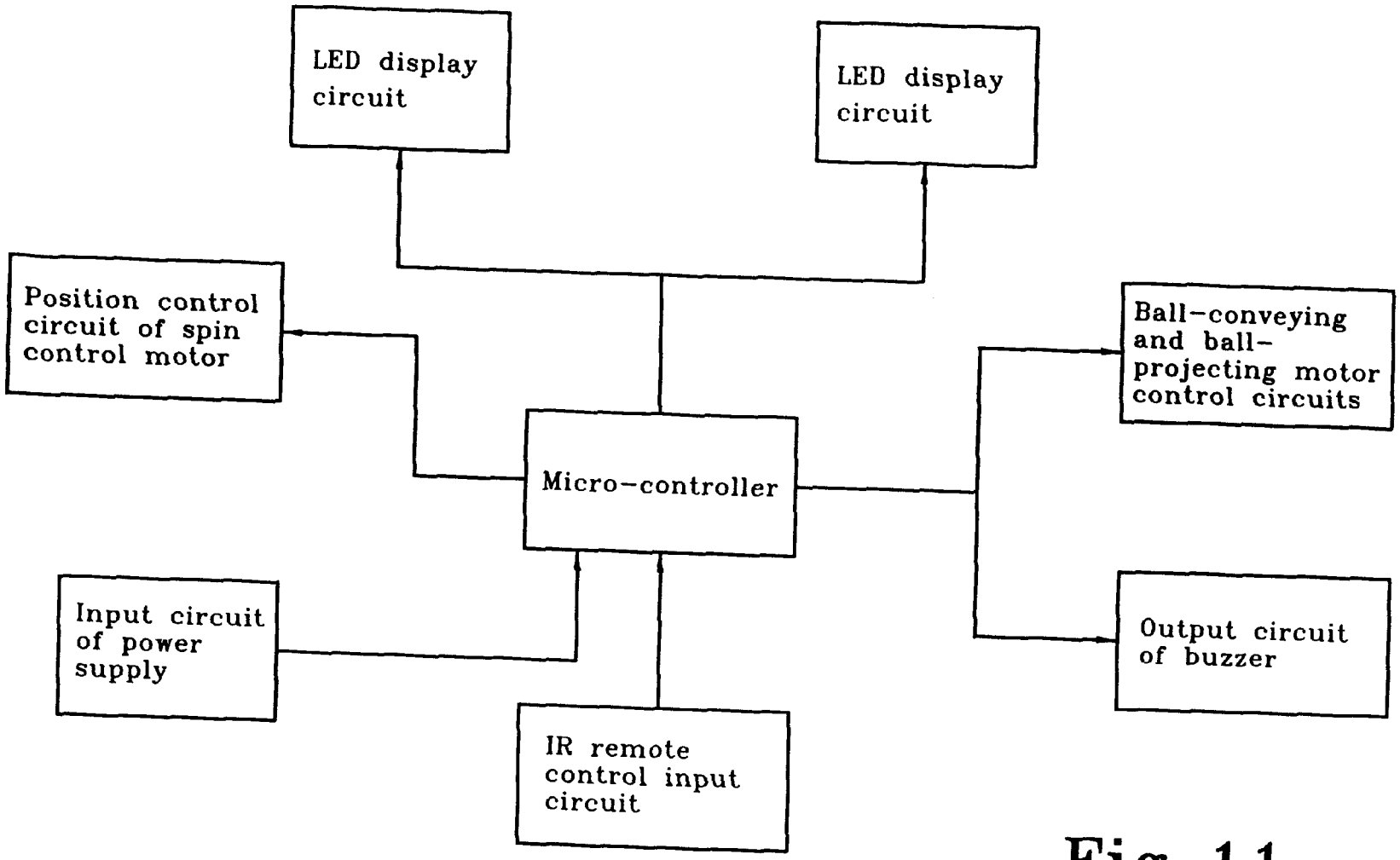
FIG. 11 is a block diagram of the control system of the invention.

If the test is completed normal, the micro-controller is then maintained at a temporary stand-by state. If a signal from the infrared controller 10 is received, the micro-controller will execute a subroutine program as instructed. Otherwise, the micro-controller will act according to a preset mode (including angle of elevation, sway direction, or spin angle in continuous or intermittent mode by automatic or manual operation, etc.) to start the conveyer 5 and project a ball by the propelling wheel 6. FIG. 11 is a diagram of the integrated system.

By virtue of the foregoing arrangement, the micro-controller can either be set by a user or preset with a program to enable the service machine to project spun balls continuously or intermittently at various angles and directions through automatically or manually controlled operations.

What is claimed is:

1. An improved structure of service machine mountable on court for table tennis, comprising:

a service machine body connectable with a table tennis court, wherein the service machine body further comprises a micro-controller used for automatic or hand-operated control of a ball-positioning mechanism built in said service machine as well as a ball-projecting mechanism coupled with said ball-positioning mechanism; and wherein said ball-positioning mechanism comprises an elevation control motor for adjusting elevational angle of said ball-projecting mechanism, and a sway control motor for adjusting deflection angle of said ball-projecting mechanism; said ball-projecting mechanism comprises a ball-conveying device and a ball-projecting device; said ball-conveying device is provided with a ball-collecting tray capable of holding a plurality of balls for delivering the collected balls via a conveyer from said service machine body to said ball-projecting device of said ball-projecting mechanism via said ball-positioning mechanism in sequence; and wherein a propelling wheel of said ball-projecting device can adjust the positional angle between itself and a ball pending a frictional snap shoot in virtue of a spin control motor and further control the spin direction of the ball; and no sooner a ball is shot, than a projecting sensor sends a signal to said micro-controller, which immediately requests said conveyer to replenish insufficient balls and push a next ball to the pending shoot position; and then and there, said elevation control motor, sway control motor, and spin control motor are standing ready in designated positions for the next shoot according to instructions of said micro-controller; and, in virtue of the foregoing structure, said micro-controller can be set by a user or preset with a program to enable said service machine to project spin balls continuously or intermittently in various angles and directions automatically or manipulatively.

2. The improved structure of service machine mountable on court for table tennis of claim 1, wherein an infrared controller can be provided to said micro-controller for remote control of the same.

3. The improved structure of service machine mountable on court for table tennis of claim 1, wherein said ball-collecting tray can be folded on said service machine body 1.

4. The improved structure of service machine mountable on court for table tennis of claim 1, wherein said elevation control motor can be further provided with one set of angle sensors to enable said micro-controller to control the elevational angle more accurately.

5. The improved structure of service machine mountable on court for table tennis of claim 1, wherein said sway control motor can be further provided with one set of angle sensors, to enable said micro-controller to control the deflection angle more accurately.

6. The improved structure of service machine mountable on court for table tennis of claim 1, wherein said spin control motor can be further provided with an angle sensor to enable said micro-controller to control spin more accurately.

* * * * *